US008052368B2

(12) United States Patent
Littlewood et al.

(10) Patent No.: US 8,052,368 B2
(45) Date of Patent: Nov. 8, 2011

(54) CATWALK FOR A DRILLING RIG

(75) Inventors: Richard W. Littlewood, Cochrane (CA); Martin Thieme, Cochrane (CA)

(73) Assignee: 762-725 Alberta Ltd., Cochrane (CA)

( * ) Notice: Subject to any disclaimer, the term of this patent is extended or adjusted under 35 U.S.C. 154(b) by 544 days.

(21) Appl. No.: 12/236,089

(22) Filed: Sep. 23, 2008

(65) Prior Publication Data

US 2010/0068006 A1 Mar. 18, 2010

Related U.S. Application Data

(60) Provisional application No. 61/097,699, filed on Sep. 17, 2008.

(51) Int. Cl.
*E21B 19/00* (2006.01)

(52) U.S. Cl. ..... 414/22.52; 414/22.57; 414/22.58

(58) Field of Classification Search ..... 14/69.5, 14/71.5, 72.5; 198/300, 302; 414/22.51–22.59, 414/22.61, 22.69, 477, 480, 482, 536
See application file for complete search history.

(56) References Cited

U.S. PATENT DOCUMENTS

| | | | | |
|---|---|---|---|---|
| 2,792,103 | A * | 5/1957 | Piemont | 198/320 |
| 3,159,286 | A * | 12/1964 | Freeman, Sr. | 414/22.61 |
| 4,382,591 | A * | 5/1983 | Minnis et al. | 269/156 |
| 4,403,898 | A | 9/1983 | Thompson | |
| 5,192,189 | A * | 3/1993 | Murata et al. | 414/477 |
| 7,134,829 | B2 * | 11/2006 | Quenzi et al. | 414/482 |
| 7,404,697 | B2 * | 7/2008 | Thompson | 414/22.58 |
| 2006/0104746 | A1 * | 5/2006 | Thompson | 414/22.54 |
| 2006/0285941 | A1 | 12/2006 | Fikowski et al. | |
| 2007/0221385 | A1 * | 9/2007 | Braun et al. | 166/379 |

FOREIGN PATENT DOCUMENTS

| | | |
|---|---|---|
| CA | 2224638 | 6/1999 |
| CA | 2496440 | 11/2003 |
| SU | 1740616 A1 * | 6/1992 |

* cited by examiner

*Primary Examiner* — Gregory Adams
(74) *Attorney, Agent, or Firm* — Bennett Jones LLP

(57) ABSTRACT

A pipe handling catwalk comprising: a deck including an upper surface, a first end, an opposite end and a tubular support surface on the upper surface, the tubular support surface being elongate and extending between the first end and the opposite end; a deck guide including a wall extending up from the deck upper surface and drivable along tubular support surface of the deck; a ramp mounted on the deck adjacent its first end and positionable extending at an angle from the deck; a carrier connected to the ramp to remain on the ramp and being moveable such that an end thereof can be lifted away from the ramp to reduce the inclination of the carrier relative to the angle of the ramp, the carrier including an upper surface and a tubular retaining surface thereon extending along the carrier substantially in line with the tubular support surface of the deck; and a carrier guide including an upstanding tubular engaging surface extending up from the carrier upper surface and drivable along tubular retaining surface of the carrier.

13 Claims, 9 Drawing Sheets

CATWALK FOR A DRILLING RIG

FIELD

The present invention relates to a catwalk for a drilling rig, which is a pipe handling machine for conveying tubulars to and from a drill rig drilling floor.

BACKGROUND

A drilling rig catwalk is a pipe handling machine for conveying tubulars between a drill rig drilling floor and a tubular supply, oftentimes located laterally offset and some distance below the floor. When conveying tubulars to the drill floor it is particularly beneficial to have the tubulars presented at a reasonable distance off the floor that they can be readily handled by personnel on the floor. However, with the floor of many rigs raised well above the store of tubulars, lifting the tubulars to a position readily handled by the rig personnel may create a dangerous situation.

SUMMARY

In accordance with one aspect of the present invention, there is provided a pipe handling catwalk comprising: a deck including an upper surface, a first end, an opposite end and a tubular support surface on the upper surface, the tubular support surface being elongate and extending between the first end and the opposite end; a deck guide including a wall extending up from the deck upper surface and drivable along tubular support surface of the deck; a ramp mounted on the deck adjacent its first end and positionable extending at an angle from the deck; a carrier connected to the ramp to remain on the ramp and being moveable such that an end thereof can be lifted away from the ramp to reduce the inclination of the carrier relative to the angle of the ramp, the carrier including an upper surface and a tubular retaining surface thereon extending along the carrier substantially in line with the tubular support surface of the deck; and a carrier guide including an upstanding tubular engaging surface extending up from the carrier upper surface and drivable along tubular retaining surface of the carrier.

In accordance with another broad aspect of the invention, there is provided a method for handling a tubular between a storage rack and a drilling rig floor, the method comprising: loading a tubular onto a deck of a pipe handling catwalk; pushing on an end of the tubular to drive it axially along the deck and up onto a ramp carrier surface spanning between the deck and the drilling rig floor; transferring the tubular to the ramp carrier surface; and pushing on the end of the tubular to drive the tubular up along the ramp carrier surface until the tubular is accessible for pick up on the drilling rig floor.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF VARIOUS EMBODIMENTS

Figure 1:
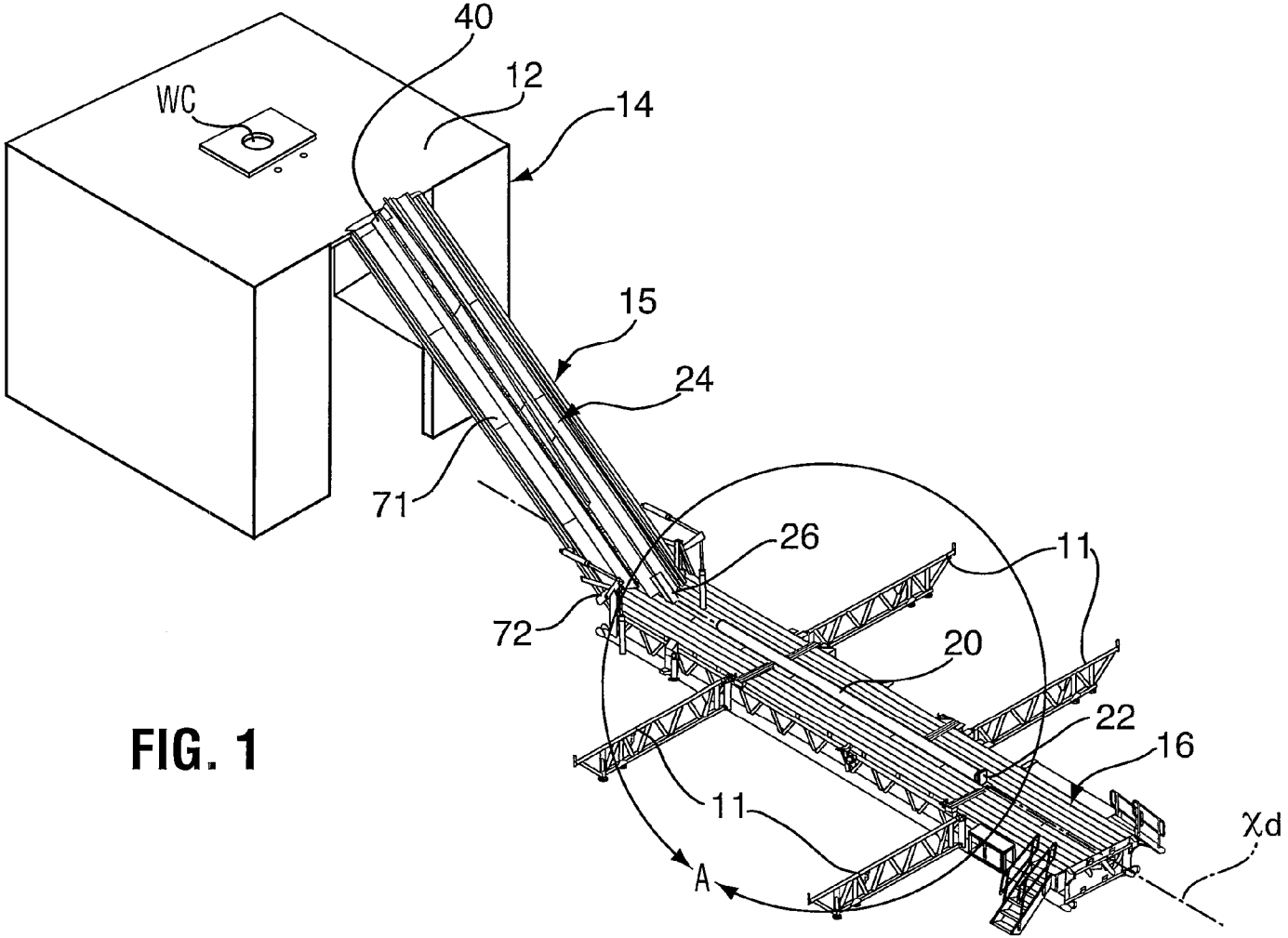
FIG. 1 is a perspective view of a drilling rig catwalk installed adjacent a drilling rig.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

A drilling rig catwalk is shown in the Figures. The catwalk acts to conveying tubulars between one or more storage racks 11 and the floor 12 of a drilling rig 14 (shown in part and schematically). The catwalk can handle tubulars such as drill pipe (including, for example, single, double or triple joint drill pipes), drill collars, casing, tools such as bottom hole assemblies, etc.

The catwalk includes a ramp 15, a deck 16 and a pipe moving system for moving a tubular along the deck and ramp. For use, deck 16 acts as a base for the catwalk and may be mounted on a ground surface 13 and ramp 15 may be positioned in an inclined fashion extending between deck 16 and floor 12 of the drilling rig. Storage racks 11 can be positioned adjacent the deck to hold a supply of tubulars (not shown).

A tubular, such as drill collar 20, may be passed between the drilling rig floor and the storage racks by the catwalk, the details of which will be more fully disclosed hereinafter. In the following discussion, the term "ramp end" is the end of the deck adjacent the ramp, while the "distal end" of the deck is the end furthest away from the end adjacent the ramp. A deck long axis $\chi d$ may be defined between the ramp end and the distal end. Also with respect to the ramp, the term "deck end" is the end of the ramp adjacent the deck, the term "upper end"

is used to reference the end of the ramp that is furthest from the deck and thereby elevated adjacent the drilling rig floor and a ramp long axis may be defined between the deck end and the upper end.

Figure 4:
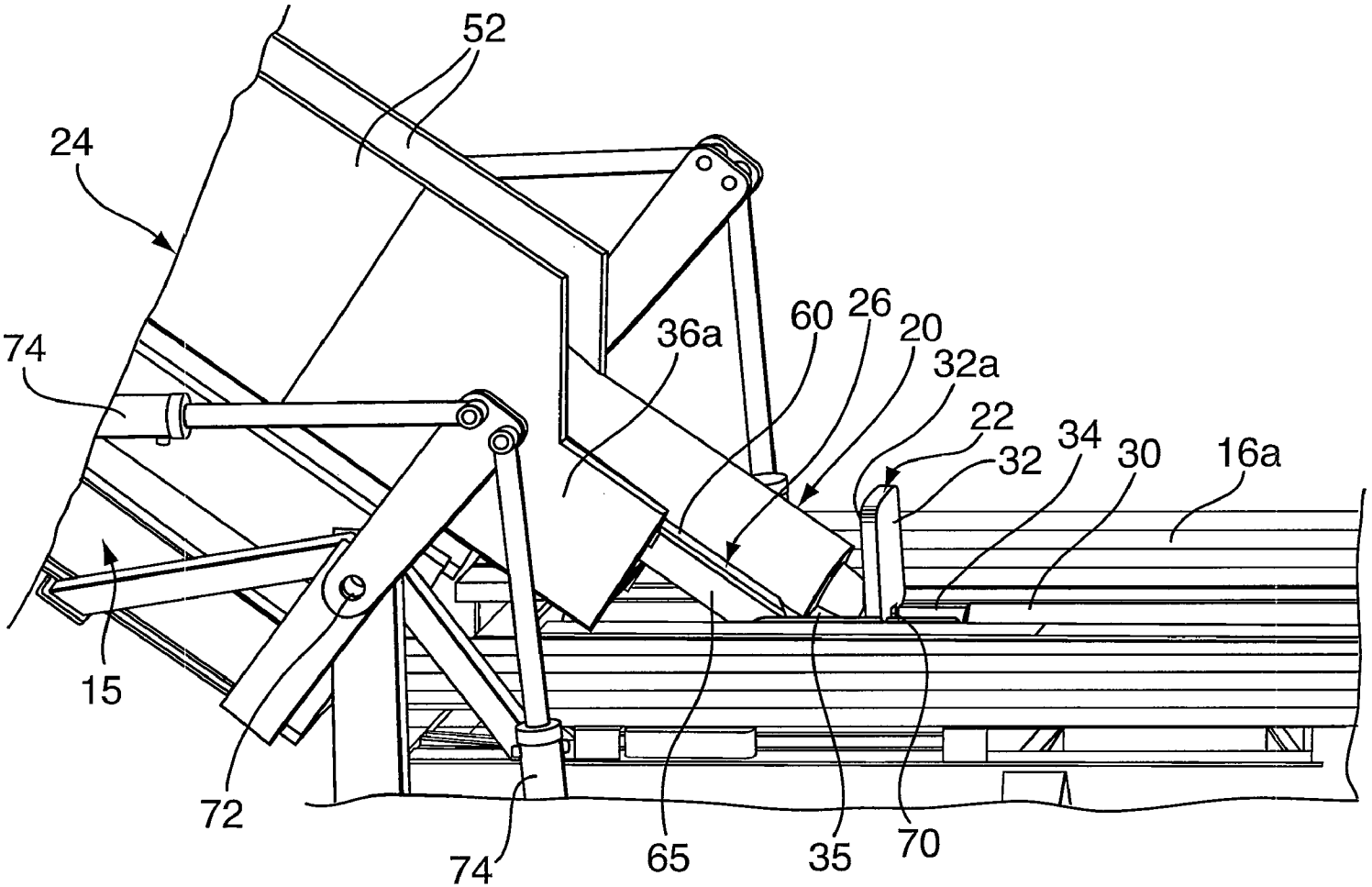
FIG. 4 is a perspective view of a portion of a drilling rig catwalk in an operational position following after that of FIG. 3 during a process of conveying a tubular from a storage area to the drilling rig floor.
Figure 5:
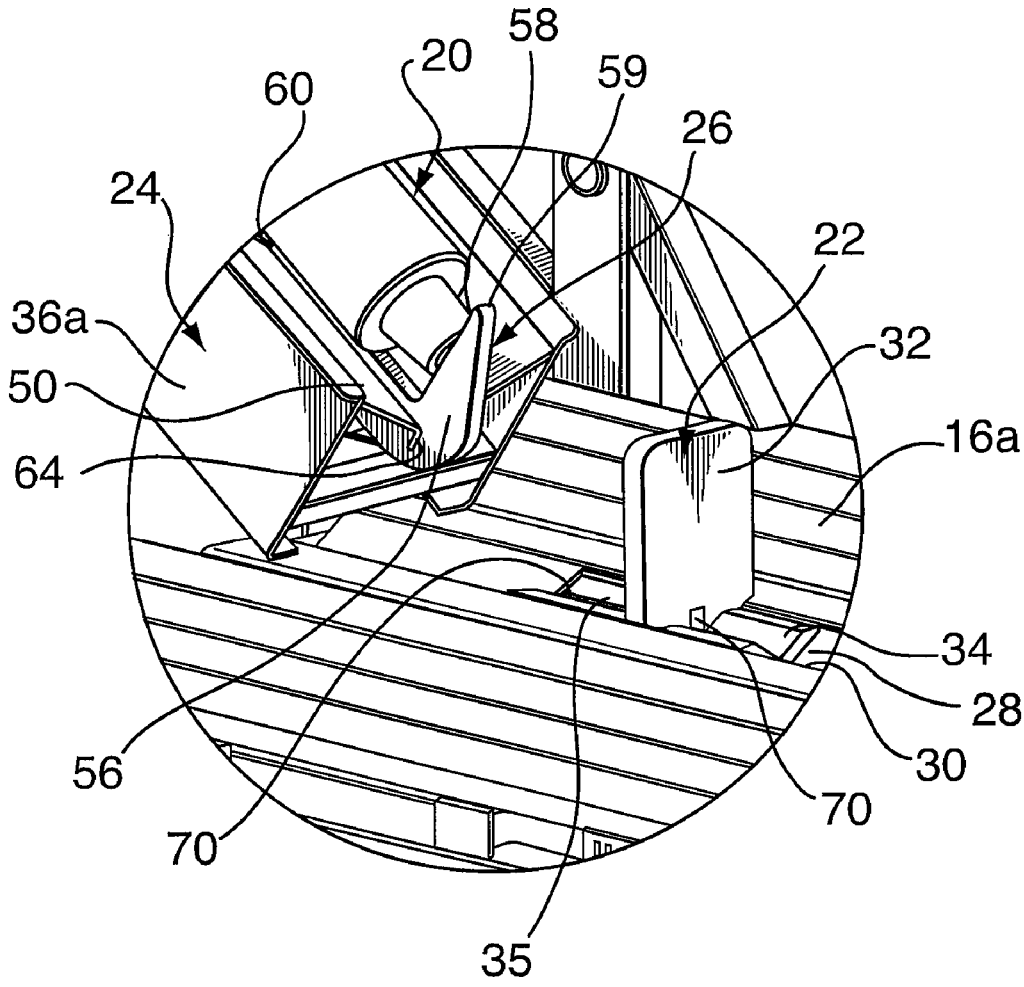
FIG. 5 is a perspective view of an enlarged portion of a drilling rig catwalk in an operational position following after that of FIG. 4 during a process of conveying a tubular from a storage area to the drilling rig floor.
Figure 6:
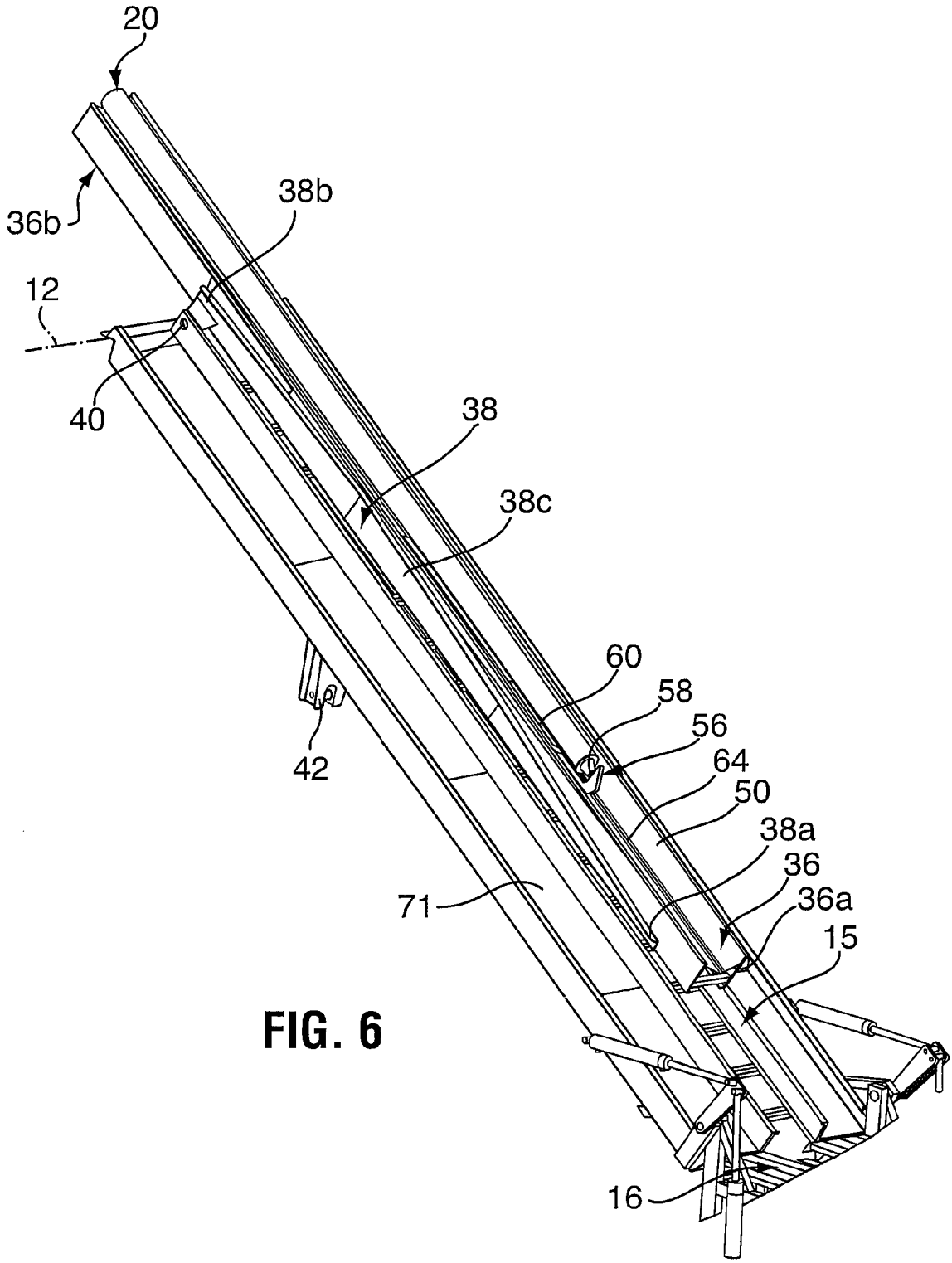
FIG. 6 is a perspective view of an enlarged portion of a drilling rig catwalk in an operational position following after that of FIG. 5 during a process of conveying a tubular from a storage area to the drilling rig floor.
Figure 7A:
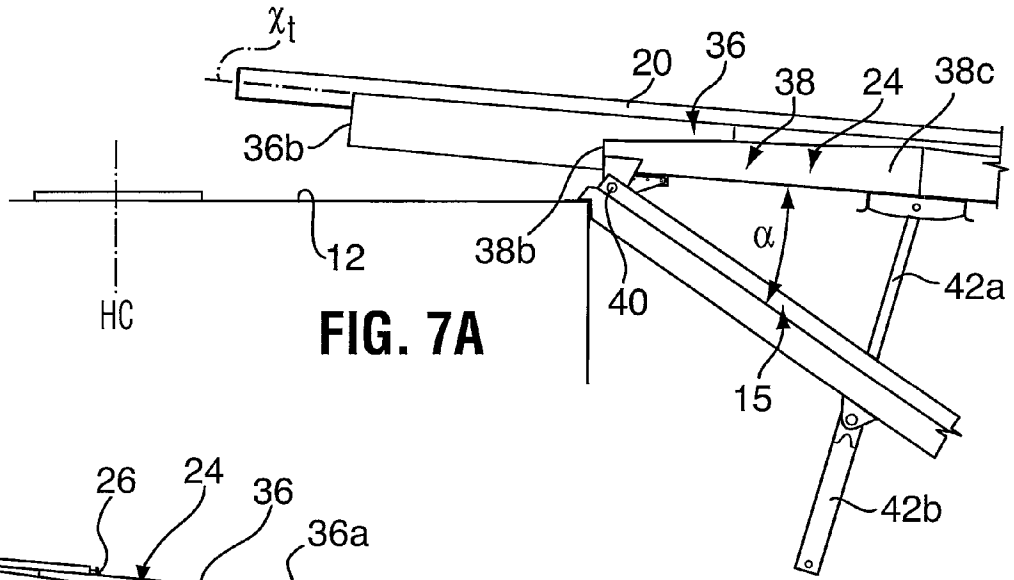
FIG. 7A is an enlarged view of area A of the drilling rig catwalk of FIG. 7.
Figure 7:
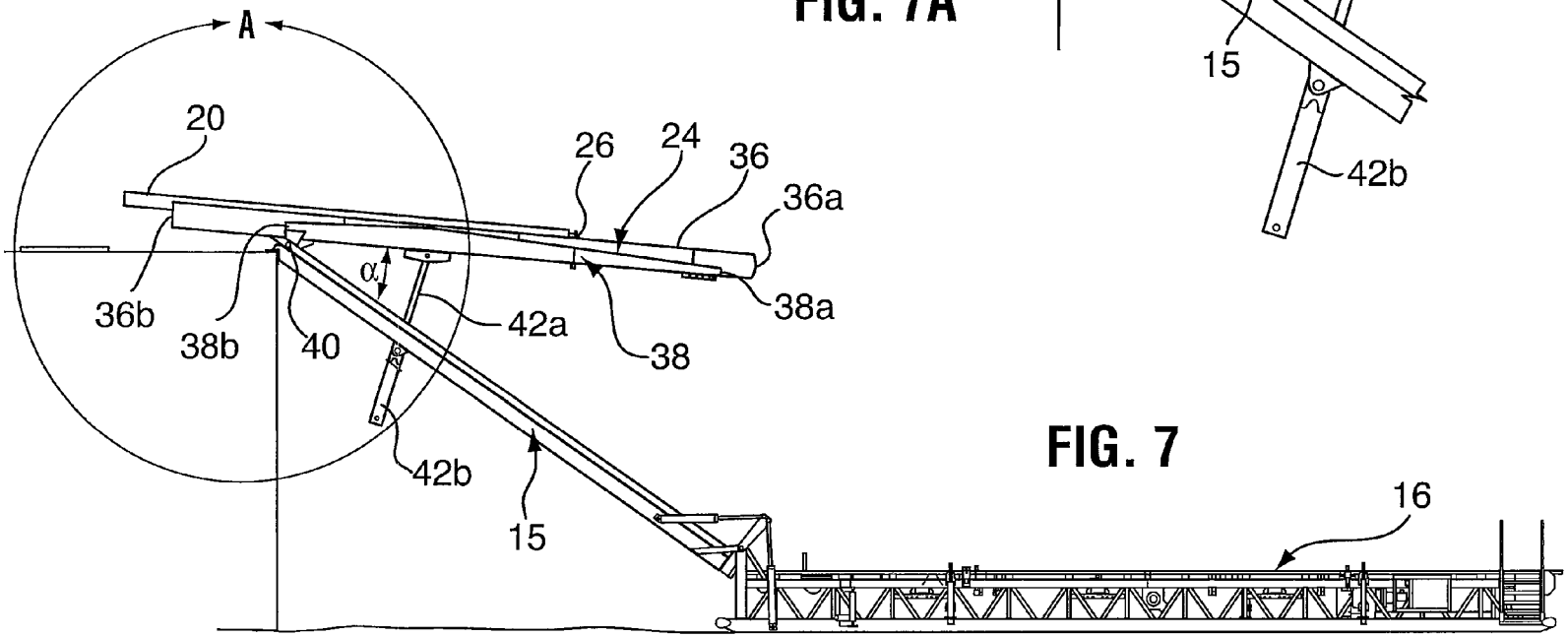
FIG. 7 is a side elevation of a drilling rig catwalk in an operational position following after that of FIG. 6 during a process of conveying a tubular from a storage area to the drilling rig floor.

The catwalk includes a pipe moving system including a carrier and a system of driven guides for moving a tubular between a lower position (FIGS. 1, 1A and 2) and an elevated, presenting position (FIGS. 7 and 7A), through various intermediate positions shown in FIGS. 3 to 6. In the illustrated embodiment, the pipe moving system includes a deck guide 22, a moveable carrier 24 on the ramp and a carrier guide 26. Deck guide 22, carrier 24 and carrier guide 26 together act to move a tubular in a direction aligned with its long axis $\chi t$ from the deck up onto the ramp carrier for presentation on floor 12. In particular, deck guide 22 acts to slide the tubular along its long axis along the deck and up onto carrier 24 on the ramp (FIGS. 1 to 4A), after which the tubular is handed off (FIG. 5) to be acted upon by carrier guide 26 and carrier 24. Carrier guide 26 supports, and possibly slides, the tubular along its long axis into position on carrier 24 and carrier 24 lifts and moves the tubular into a position extending substantially horizontally above the rig floor 12 (FIGS. 6 to 7A). Although for convenience, the operation of the catwalk is described mainly with respect to the operations to move a tubular to the drill floor, the catwalk can also be operated to lay down a tubular in a controlled manner. For example, to remove a tubular from the rig floor, the carrier is positioned in the position extending substantially horizontally above the rig floor and receives a tubular thereon. The carrier and guides 26 and 22 move and guide the tubular, using gravity in part, to slide the tubular down onto the deck.

Deck guide 22 may be used to guide movement of a tubular in line with its long axis along the deck long axis. Guide 22 may be driven to slide a tubular axially along deck long axis $\chi d$ toward and onto the ramp and to guide movement of a tubular along the deck long axis, as driven by gravity, off and away from the ramp. Deck guide 22 is formed as a protrusion extending up from the upper surface 16*a* of the deck sized to engage against an end of a tubular to be handled and connected to a drive system 27 that moves guide 22 along the upper surface in a path along or parallel to the deck long axis. Deck 16 includes an upper surface 16*a* including a tubular supporting surface. The tubular supporting surface can be formed such that a tubular 20 received thereon gravitates to a lowermost, centrally located, cradled position, as illustrated by the various drawings. For example, an elongate indention 28 may be formed with inclined sides extending down from the main planar surface of the deck and converging at a slot 30 in which deck guide 22 moves. Drive system 27 may take various forms including any or a number of hydraulics, magnetics, cable drives, etc. In one embodiment, drive system 27, for example, may include a cable drive with a continuous cable (chain or cable) engaged by gears or wheels and driven by a motor and drive shaft (shown at 27) and guide 22 may be connected to the cable to be driven back and forth along slot 30. The cable can be continuous so it can easily be driven both toward and away from ramp end. Indentation 30 is itself immovably positioned on deck 16 but guide 22 may be moved therealong to drive a tubular along the deck. Guide 22 may be connected to the drive system at a connection below upper surface 16*a* of the deck. For example, guide 22 may include a lower extension through which it is connected to a continuous drive cable, gears and motor, etc., all of which may be installed in the support framework 16*b* of the deck.

Slot 30 may be formed along substantially a full length of deck 16 such that the guide can have a range of movement along most of the deck. As will be appreciated more fully from further description herein after, slot 30 may be formed to extend very close to the ramp end of the deck such that the guide can move in close proximity to ramp 15.

In the illustrated embodiment, deck guide 22 includes a wall 32 having a substantially planar surface positioned substantially orthogonal to the deck long axis and a slider 34 that supports wall 32 and rides along slot 30. Wall 32 may have a width that spans the width of the indentation and a height selected to be at least one half the diameter of the largest diameter tubular intended to be handled and in one embodiment may be at least as high as the diameter of the largest diameter tubular to be handled.

Slider 34 may be formed to follow the curvature of indentation 28, for example, including plates that overlie and substantially follow the surface curvature of the indentation's inclined sides and a rail that rides below slot 30. The plates may extend forwardly and laterally outwardly, and possibly rearwardly, about wall 32 such that the plates can bear against the material forming the deck upper surface and stabilize the wall against kicking sideways, forward and back, even when under load. A portion 35 of the plate adjacent the tubular contact surface 32*a* of the wall can be formed to support an end of the tubular to be handled. In one embodiment, portion 35 is a length greater than any pin end length of a tubular to be handled.

Carrier 24 and carrier guide 26 are positioned on ramp 15 to move a tubular relative to the ramp. Carrier 24 includes a body with an upper pipe carrying surface 36. Carrier 24 is moveable relative to the ramp to lift and move a tubular between an inclined position similar to that of the ramp to a less inclined position, closer to horizontal. Carrier 24 may, for example, be moveable vertically and/or pivotally relative to the ramp and/or axially moveable along the ramp's long axis. In the illustrated embodiment, for example, carrier 24 may include a upper member 36 mounted on a support body 38 that is pivotally moveable relative to the ramp from a position overlying the ramp at an angle of inclination similar to that of the ramp to a position more horizontally oriented than that angle of inclination of the ramp. For example, support body 38 may be connected by a hinge 40, in a fixed position, to upper end of ramp 15 and the support body with upper member 36 thereon may pivot about the hinge. A driver may be provided to drive the pivotal movement of body 38 about the hinge. While various drivers such as screw drives, linkages, etc. may be useful, a simple driver may include a pressure driven cylinder 42 connected between the ramp and the body. The cylinder's rod 42*a* may be connected to one or the other of ramp 15 and body 38 and the cylinder's housing 42*b* is connected to the other of the ramp or the body, with suitable sliding and/or pivotal connections to permit the body to be driven about hinge 40, which can be best seen by comparison of FIGS. 2 and 7. The stroke length of cylinder 42, for example the degree to which the cylinder's rod 42*a* can be extended from the housing 42*b*, can be selected to control the range of motion about the hinge. For example, a longer stroke length will provide a greater range of pivotal motion around hinge 40 than a shorter stroke length. The stroke length and thereby the range of pivotal motion around the hinge, may be selected depending on various factors. In one embodiment, the height H of the rig's floor will be considered when determining these selections. For example, if the rig floor height H is higher, the angle of ramp's inclination will be steeper than for installation against lower floors. The inclination of the ramp will determine the angle $\alpha$ through which carrier 24 must be rotated to move it from an angle similar to that of the ramp to an angle close to horizontal. As such, the stroke length of cylinder 42 is necessarily longer for an installation where ramp 15 is significantly inclined to reach a higher drill floor than in an installation where the ramp is less inclined.

A shock absorber may be provided for absorbing shocks applied to carrier 24. In one embodiment, for example, cylinder 42 may be selected to have a shock absorbing feature. For example, in one embodiment, cylinder 42 may have excess stroke length beyond its intended extension for raising carrier 24. Alternately or in addition, clinger 42 may include a pressure relief valve. As such when carrier 24 is positioned for receiving tubulars from the drill floor and a tubular is placed with extraordinary force on the carrier, such as if a tubular were dropped, cylinder may provide shock relief. For example, there may be a further range of movement available between rod 42*a* and housing 42*b* to accommodate the shock. It may be ensured, such as by selection of cylinder parameters, operator control or sensors, that such extra stroke length is not manually utilized, but held in reserve. Alternately or in addition, relief valves in the cylinder may operate to vent hydraulic fluid when the carrier is subjected to higher than normal forces.

Upper member 36 may be axially moveable on support body 38, if desired. For example, upper member 36 may be slidably moveable relative to body 38. As can best be seen by comparison of FIGS. 2, 6 and 7, upper member 36 may be mounted by a drive assembly on support body 38 such that the carrier may be moved axially over support body 38 between a first, retracted position where a deck-adjacent end 36*a* of upper member 36 extends at a deck-adjacent end 38*a* of the support body (FIG. 2) to an extended position where an upper end 36*b* of the upper member extends out from an upper end 38*b* of the support body (FIGS. 6 and 7). While various drive assemblies may be used, such as hydraulics, screw drives, magnetics, cable drives, etc, in one embodiment, the drive assembly includes a hydraulic system including a hydraulic cylinder 44 acting between the upper member 36 and support body 38. The cylinder's rod may be connected to one or the other of the upper member 36 and body 38 and the cylinder's housing may be connected to the other of the member or the body, with suitable sliding connections to permit the upper member to be driven axially over support body 38. The stroke length of the cylinder can be significant such that the relative axial range of movement can be 6 to 10 feet.

The connections between member 36 and body 38 may also or alternately be provided with a shock absorber. For example, the drive assembly can act to absorb shocks applied to carrier 24. In one embodiment, for example, cylinder 44 may be selected to have a shock absorbing feature. For example, in one embodiment, cylinder 44 may have excess stroke length beyond its intended extension for extending member 36. Alternately or in addition, cylinder 44 may include a pressure relief valve. As such when carrier 24 is positioned for receiving tubulars from the drill floor and a tubular is placed with extraordinary force on the carrier, such as if a tubular were dropped, cylinder 44 may provide shock relief. For example, there may be an excess stroke length and/or relief valves to accommodate the shock. It may be ensured, such as by selection of cylinder parameters, operator control or sensors, that such extra stroke length is not manually utilized, but held in reserve. Alternately or in addition, relief valves in the cylinder may operate to vent hydraulic fluid when the carrier is subjected to higher than normal forces.

Support body 38 may be formed to support and direct the axial sliding movement of carrier 24. For example, body 38 may be formed as an elongate member with a U-shaped cross section including a base and a pair of spaced walls 38*c* between which the upper member slides and is maintained.

As pipe sections 20 are lifted above the deck and the ramp, it may become important to ensure that the pipe sections are well retained on the carrier. Carrier guide 26 retains a tubular on the carrier from slipping axially along the carrier. Further, upper member 36 of the carrier can be formed such that a tubular 20 received thereon gravitates to a lowermost, centrally located, cradled position. For example, the upper member may include an upper surface with an elongate indention 50 formed with inclined sides extending down to converge at a base line. In one embodiment, to completely avoid any risk of a pipe rolling sideways off the carrier, a lateral wall 52 (shown only in FIG. 4) can be installed along each side the upper surface, for example, each extending along one side of indentation 50. Lateral walls 52 can be any height, for example extending well above the diameter of any tubular to be handled. The lateral wall can also take various forms such as a solid, perforated, framework or pin structure. In one embodiment, wall may be sufficiently solid to avoid catching an end of the tubular as it is being slid therebeside and in case the tubular comes into contact with the wall. Of course, lateral walls 52 may replace indentation 50, if desired.

Carrier guide 26 may be used to guide movement of a tubular in line with its long axis $\chi t$ along the carrier upper member 36. Carrier guide 26 may be driven to slide a tubular axially along the length of the carrier toward the upper end of the carrier and to guide sliding movement of a tubular axially along the carrier, as driven by gravity, off and away from the carrier onto the deck. Carrier guide 26 is formed as a protrusion extending upwardly from the upper surface of upper member 36 of the carrier and is sized to engage against an end of a tubular to be handled. In the illustrated embodiment, carrier guide 26 includes a finger 56 having a facing surface 58 positioned substantially orthogonal to the carrier indentation and a slider 60 that supports finger 56 and rides along carrier 24. Finger facing surface 58 may have a height selected to be at least one half the diameter of the largest diameter tubular intended to be handled and in one embodiment may be at least as high as the diameter of the largest diameter tubular to be handled.

Carrier guide 26 is connected to a drive system that moves the guide along upper surface 36 axially along the carrier. In particular, a slot 64 may be formed along the base line of elongate indentation 50 and carrier guide 26 can be installed to be driven to move along the slot. The drive system for the carrier guide may take various forms including any or a number of hydraulics, magnetics, cable drives, etc. In one embodiment, the drive system, for example, may include a cable drive with a cable (chain or cable) engaged by gears or wheels and driven by a motor and drive shaft or hydraulics and guide 26 may be connected to the cable to be driven back and forth along slot 64. Guide 26 may be connected to the drive system at a connection below the upper surface of upper member 36. For example, guide 26 may include a lower extension 65 through which it is connected to a drive cable, gears and motor, etc., all of which may be installed in the support framework of the carrier.

Slider 60 may be formed to follow the curvature of indentation 50 for example including plates that overlie and substantially follow the surface curvature of the inclined sides. The plates may extend forwardly and laterally outwardly, and possibly rearwardly, about finger 56 such that the plates can bear against the material forming the upper surface and stabilize the finger against kicking sideways, forward and back, even when under load. A portion of the guide adjacent facing surface 58 of the finger can be formed to support an end of the tubular bearing against finger 56. In one embodiment, the portion of the guide is a length greater than any pin end length of a tubular to be handled.

The length of the slot formed along the carrier determines the range of motion that can be achieved for guide 26 along the carrier. In the illustrated embodiment, slot 64 may extend substantially the full length of upper member 36 such that the guide can also move substantially along the full length of the carrier upper member 36, thus allowing tubulars of varied lengths to be handled, including those as long as the carrier and those quite short. In the illustrated embodiment, slot 64 may extend close to the lower end 36*a* of the carrier such that guide 26 is free to move close adjacent and possibly extend in part off the end of upper member 36.

Guides 22 and 26 manipulate a tubular over the deck and carrier to move it to and from the drilling rig floor 12. As noted hereinabove, when moving a tubular toward well center, guide 22 drives the tubular to axially slide along deck 16 and up onto the carrier on ramp 15. Slot 30 is formed such that guide 22 can move the tubular well up onto the ramp. For example, as noted hereinabove, slot 30, and therefore guide 22, may extend to a position close adjacent the base of ramp 15. Guides 22 and 26 may be formed to interact to allow a hand off of the tubular from one guide to the other guide. For example, as best seen in FIGS. 4 and 5, when moving a tubular up toward the drilling rig, guides 22 and 26 interact to provide a controlled hand off from guide 22 to guide 26. In particular, guide 22 and guide 26 can include releasably overlapping parts, which are parts formed to releasably fit together or slide past one another. In one embodiment, finger 56 is sized and formed to pass through slot 30 on deck 16 such that it can be driven through slot 30 to be recessed below the upper surface of deck 16. In addition or alternately, guide 22 may include a bifurcated area on slider 34 forming an open ended opening 70. Opening 70 may possibly also extend through a portion of wall 32, as shown. Opening 70 is formed to allow finger 56 to pass freely therethrough such that the guides can overlap with finger 56 passing beneath the slider and, thereby, beneath upper surface 16*a* of the deck. For example, guide 22 may be formed with opening 70 positioned above an open area, free of drive system components and other structures such that finger 56 of guide 26 can freely pass down through the opening to be recessed below deck surface 16*a*. Guide 26 can be formed such that while it remains connected to and controlled by its drive assembly, it can be moved out at least in part beyond end 36*a* of the upper member so that it can bridge any gap between deck 16 and carrier upper member 36. In one embodiment, for example, slider 60 is elongate including a connection to drive assembly adjacent one end. Finger 56 may be positioned on the slider adjacent the end opposite the drive connection. In this way, slider 60 may remain connected and controlled by the drive assembly below the upper surface while finger 56 extends beyond the end of the slot and may extend beyond the end of member 36. As such, guide 26 may be positioned with its slider bridging any gap between carrier 24 and deck 16 and finger 56 recessed below deck 16 and guide 22 may be run along its slot 30 until opening 70 in its slider is moved around finger. In this position, any tubular retained against wall 32 may be transferred to be handled by guide 26 by moving finger 56 up through opening 70 such that the finger lifts the tubular off guide 22. Finger 56 may be formed with a wedge-shaped tip 59 to facilitate its operational movements to move past guide 22 and to engage an end of the tubular. In particular, if the relative positions of guide 22 and finger 56 are slightly off during a handoff, the wedge-shaped form of the finger may allow the finger to push past the guide.

Ramp 15 is formed to support and retain carrier 24 as it moves thereover through its various operational positions. Ramp 15 includes an upper end 15*a* including a bearing surface capable of engaging on drilling rig floor 12. The portion of the ramp over which the carrier is mounted may include an opening to allow cylinder 42 to extend down into an operational position. Other areas of the ramp may also be formed open, as by use of a framework construction to reduce its weight, while providing adequate strength. Ramp 15 may further include a slide 71 which can function as a standard V-door slide should it be desirable to move tubulars between the drilling rig floor 12 and the deck without operation of carrier 24.

Figure 8:
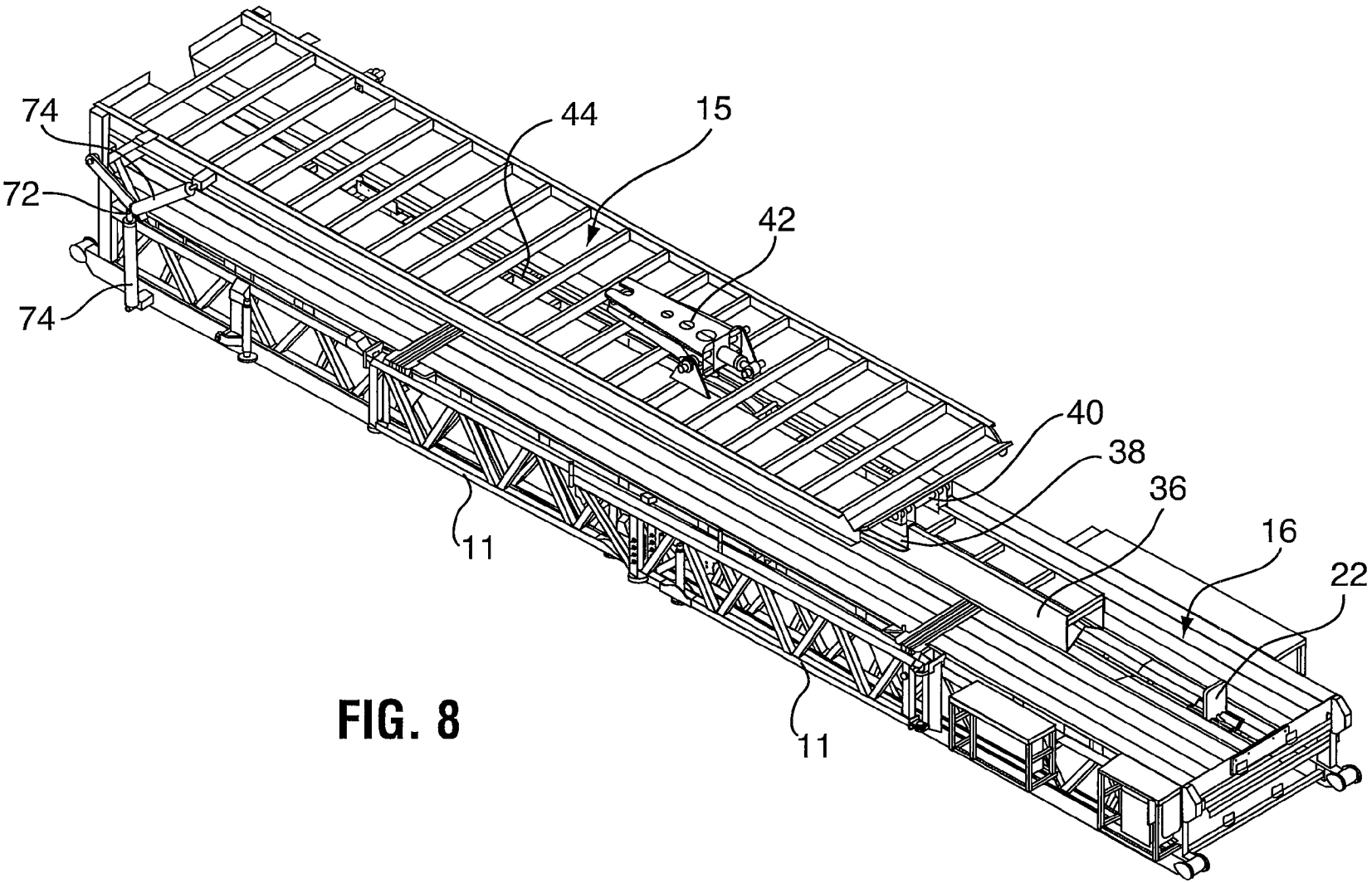
FIG. 8 is a perspective view of a drilling rig catwalk in a storage position for transport.

Ramp 15 may be hinged to deck 16 through, for example, a hinge 72 to enable the ramp to be folded back onto the deck, if desired, thereby enabling the entire catwalk to be folded into a compact package for transporting to the next drilling site (FIG. 8). Cylinders 74 may be provided to drive movement about hinge 72, as desired. The apparatus may be skid mounted to facilitate transport.

Deck 16 provides a surface over which the tubulars may be moved when they are loaded or dumped between indentation 28 and racks 11. In one embodiment, a pipe-moving apparatus is shown including kickers 78 located at spaced-apart locations along deck 16. Kickers 78 can take various forms and modes of operation. Kickers 78 operate to move up and down relative to deck upper surface 16*a* in indentation 28 and along the deck on either side of the indention to move the pipes into and out of the indentation and laterally over the deck. Since indentation 28 acts to retain a tubular while it is being slid along the deck, the indentation may be formed to create a recess to adequately hold the tubular. However, in one embodiment, kickers 78 may be raised above deck surface 16*a* during tubular sliding to further hold the tubular in the indentation. Other devices in addition to or apart from kickers 78 may be used to control pipe movement. For example, pins 80 can extend up from the deck or the rack surfaces to control pipe movement.

The pipe-handling apparatus may be controlled for operation of the various components and features thereof. It may be desirable to provide a control system that operates through programmed features to intelligently guide operations. This reduces the need for constant manual supervision and reduces the possibility of operator error. For example with reference to the illustrated embodiments, the controller may be programmed to accept a command such as "load" for loading a pipe to the deck, wherein the controller ensures all of kickers 78, guide 22, guide 26 and carrier 24 operate accordingly and in proper sequence and are positioned properly to present a tubular adjacent well center. Of course, other commands may be programmed to "unload" or move the catwalk components only through selected steps of a loading or unloading operation. The control system may also be programmed to accept a tubular type such as drill collar or triple stand drill pipe, and automatically move guides 22, 26 into and through appropriate positions along their slots to accommodate that length of tubular. This may prevent the tubular from being pushed too far over the drill floor, or having guide 22 so far back that time is wasted in bringing into a pipe engaging position.

In operation, the catwalk is delivered to a drilling site and positioned adjacent a drilling rig. Ramp 15 may be unfolded from a position, as shown in FIG. 8, into an operative position, such as in FIG. 1, set against the rig so that its upper end is adjacent the rig floor. The ramp may be allowed to rest freely on the rig drilling floor. The catwalk is constructed to work with a wide range of rig heights, the only consideration being that the length of the ramp and its components need be at least slightly longer than the height H between floor 12 and the ground surface 13 on which deck is installed. Once the ramp is set against the rig, cylinder 42 stroke length may be selected to be capable of best orienting carrier 24 relative to the rig floor.

Pipe racks 11 are attached or folded out on either side of deck 16 so that new pipe to be used can be placed on one side of the deck while pipe which comes out of the hole can be placed on the rack on the opposed side of the structure.

Figure 1A:
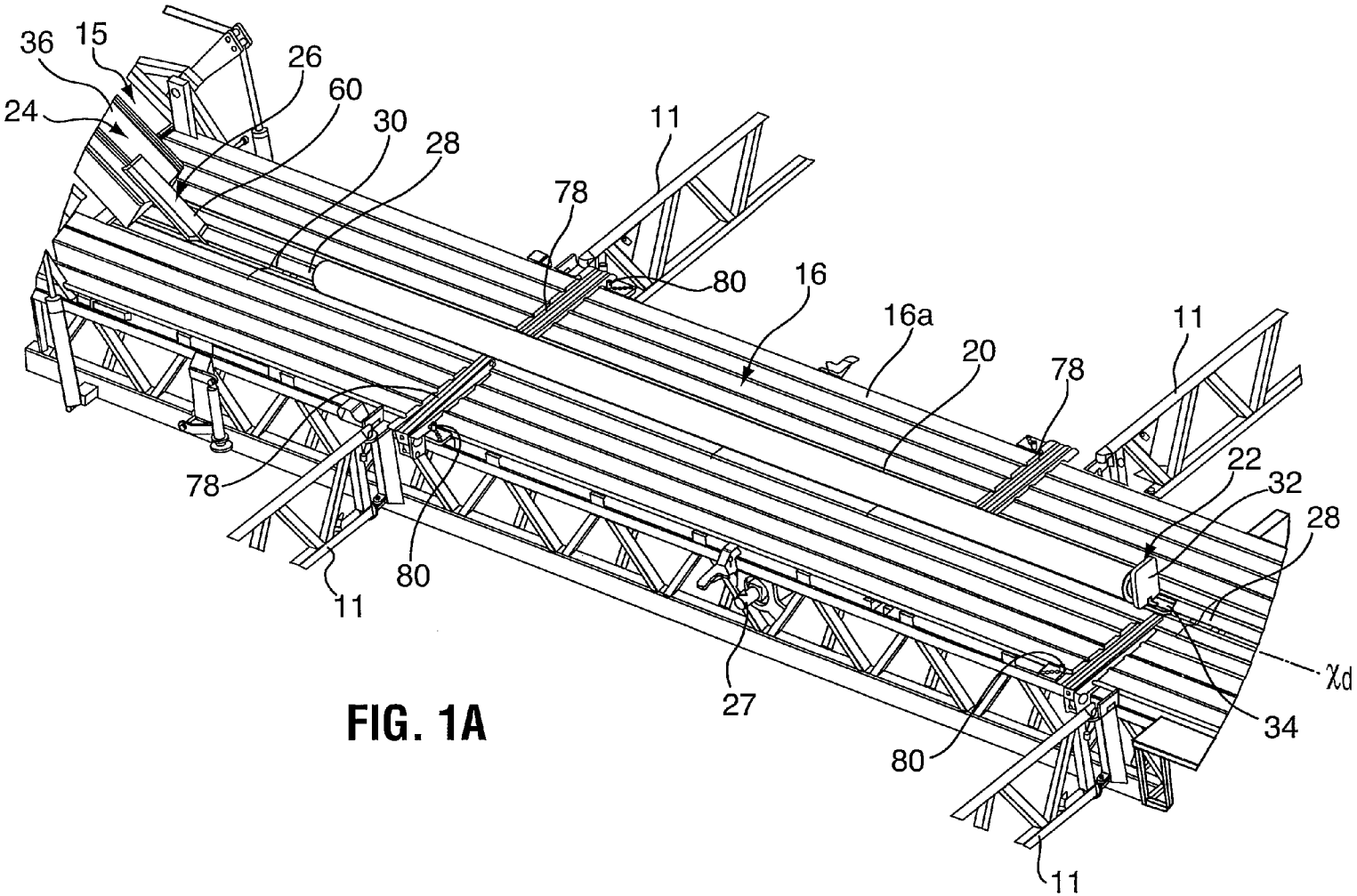
FIG. 1A is an enlarged view of area A of FIG. 1.
Figure 2:
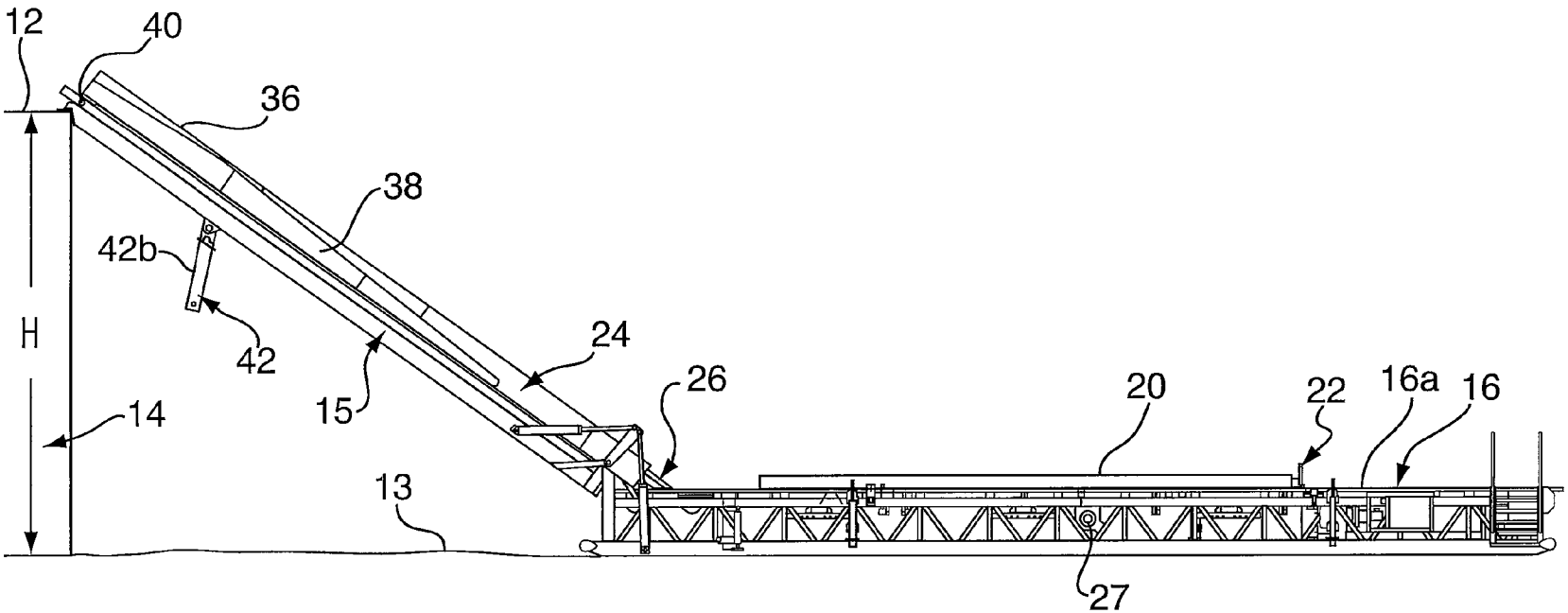
FIG. 2 is a side elevation of the drilling rig catwalk and drilling rig of FIG. 1.

When the catwalk and racks are set up and ready for operation, tubulars such as drill collar 20, drill pipe, casing, BHA, etc., are rolled from the pipe rack and into indentation 28 (FIG. 1). The racks can be tilted so that the tubulars roll by gravity against kickers 78, pins 80 or other means that drive or control pipe movement across the deck.

In preparation for accepting a tubular, deck guide 22 may be moved to a position adjacent the distal end and, for example, to at least a position allow a tubular from the rack to enter the indentation between guide 22 and ramp 15. It will be appreciated then that the starting position of guide 22 may be along slot 30 as close to the distal end of the deck as possible or dependent on the length of a tubular to be handled.

In general, the tubular can be loaded to indentation 28 at any point between the guide and the ramp, as any space between the guide and the tubular can quickly be eliminated by moving the guide along the slot. For example, deck guide 22 may be driven by drive system 27 along the slot in deck 16 to bring wall 32 to bear against and drive tubular 20 axially along indentation 30. As the tubular approaches ramp 15, carrier 24 and carrier guide 26 are in or brought into position to accept the tubular. It is to be noted that the operations of carrier 24 and guide 26 are in some cases isolated from the operations of guide 22 and, as such, carrier 24 and guide 26 need not be in position during the initial loading of a tubular onto deck 16 and indentation 30, but need only be in a position to accept the tubular, as the tubular's end approaches the ramp. As will be appreciated, this allows carrier 24 to be operated to lift a first tubular to the drill floor while a second tubular is being loaded onto the deck. This may allow pipe handling to occur at a greater rate than in some previous pipe handling apparatus where a deck mounted assembly carries the tubular fully from the deck position to a presentation position at the drill floor.

In any event, as the tubular approaches the ramp, guide 26 is positioned to accept a hand off and transfer of control for the tubular. In the illustrated embodiment, finger 56 of carrier guide 26 is positioned through slot 30 and is recessed below deck surface 16*a* at the ramp end of the deck. This also positions Slider 60 to bridge any gap between deck surface 16*a* and carrier upper member 36.

Figure 3:
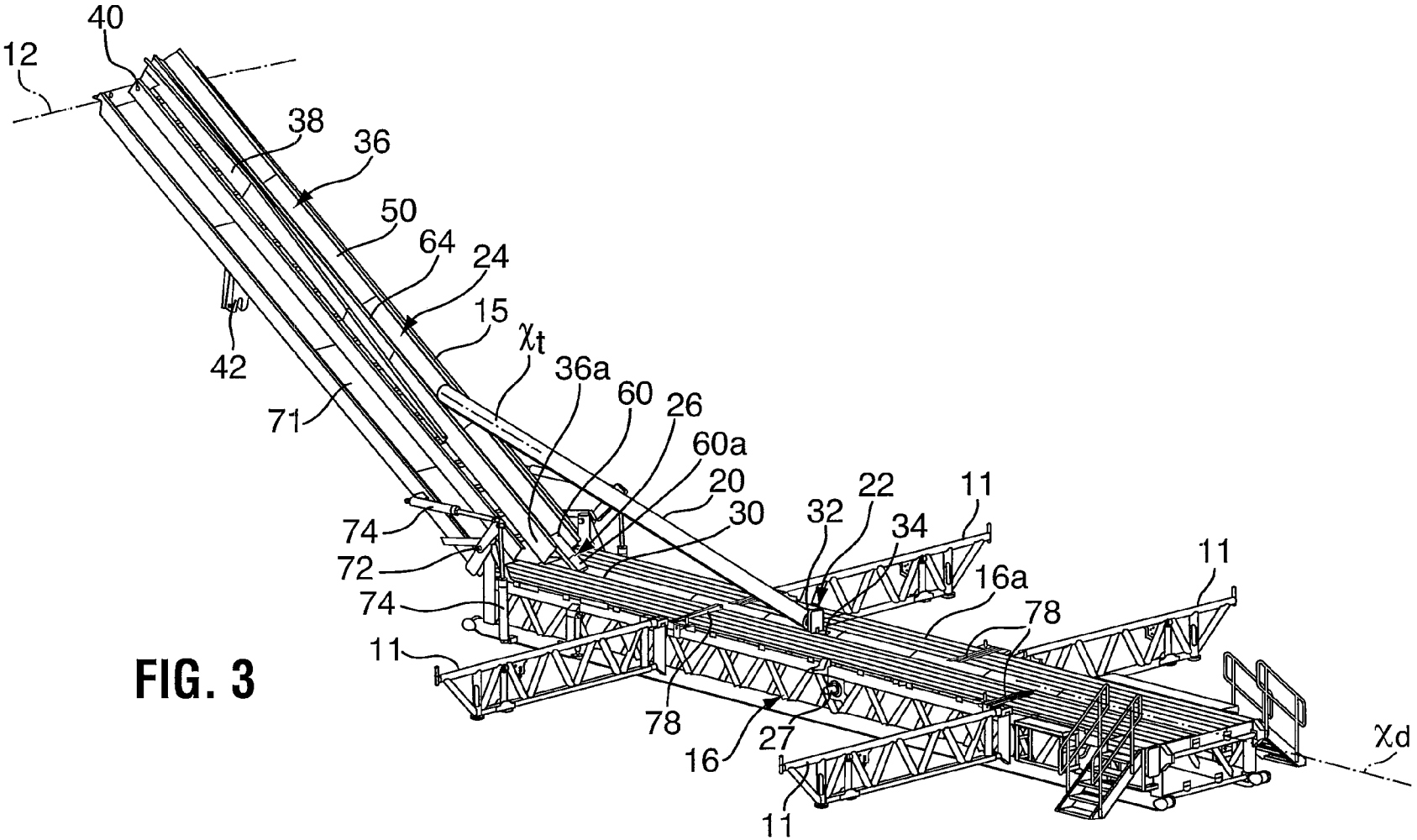
FIG. 3 is a perspective view of a drilling rig catwalk in an operational position during the process of conveying a tubular between a storage area and the drilling rig floor.

As shown in FIG. 3, guide 22 can continue to be driven to push the tubular up over slider 60 of the carrier guide and onto the carrier indentation 50. As guide 22 approaches ramp 15, the bifurcated region on slider 34 about opening 70 moves around finger 56 such that the guide overlaps the finger as it remains recessed below the deck (FIG. 4). Guide 22 can then be stopped and guide 26 can be driven to move finger out of slot 30 and through opening 70 to engage tubular 20 and lift it off guide 22, as shown in FIG. 5.

Guide 22 is then free and can, if desired, be moved back along slot 30 toward the distal end of the deck in preparation for accepting a next tubular.

With the weight of tubular 20 supported on upper member 36 and finger 56, the tubular can then be moved by the carrier and guide 26 to a position over the drilling floor 12 to be engaged by the drilling rig drawworks (not shown). To achieve this result, the carrier and the guide may be moved in various sequences or together. In one process, for example shown in FIG. 6, after finger 56 lifts the tubular off of guide 22, the carrier guide continues along slot 64 to bring the tubular to the upper end 36*b* of the upper member. At the same time or in sequence, member 36 is axially driven upwardly along support body 38, as by operation of its drive assembly. Thereafter, as shown in FIG. 7, cylinder 42 is actuated to lift carrier 24 away from ramp 15 as by rotating the carrier about hinge 40. This brings the approach angle of the tubular into a more horizontal position and at a level accessible by personnel on the drill floor such that the tubular can be connected by the personnel to the drawworks. If desired, once carrier 24 is rotated up into a more generally horizontal position, guide 26 can be further driven by its drive system along slot 64 to slide the tubular out beyond end 36*b* of member 36, as is shown in FIG. 7. Depending on the proximity of slot 50 to the end of the carrier and the length of the tubular being handled, the guide can push a tubular well out over the drill floor toward well center.

Carrier 24 can, alternately, be rotated prior to moving the tubular up along the ramp (i.e. sliding the tubular along the upper member and the upper member up along the support body). However, the order of moving the tubular higher up along the ramp before rotating the carrier facilitates rotational movement of carrier 24 by moving the carrier/tubular center of gravity closer to the hinge.

Once the tubular is engaged and lifting is initiated by the drawworks, the lower end of the tubular can be retained on upper member 36 and slid therealong and/or can be guided therealong by guide 26, indentation 50 and/or lateral walls 52. Therefore, as the tubular is lifted, its lower end can remain supported on upper member 36 and can be controllably moved toward well center such that any force driving the tubular to swing is reduced when the tubular is finally lifted off the carrier. By extending the upper member close to well center the control of the tubular is facilitated. If guide 26 is used to support and move the end of the tubular, the operator can control movement of the guide by watching the tubular/guide interaction and/or the movement of the upper end of the tubular. Hydraulic proportional controls may be provided for guide 26 such that it can be adequately controlled. In one embodiment, finger 56 can be adapted, as by shaping, to engage, or be engaged by, an end of the tubular being handled.

After the tubular is lifted from the carrier, the carrier can be moved away from the drill floor such as by retracting cylinder 42 to reverse the rotation of the carrier and/or axially moving member 36 back along support 38 away from the drill floor. In one embodiment, carrier 24 and guide 26 are returned to their lower most positions to be ready to accept a next tubular from the deck.

When the time comes to remove a pipe string from the hole, the string may be broken out by disconnecting the tubulars forming the string. Some or all of the tubulars may be returned to racks 11 or other storage on ground 13 by operation of the catwalk. In so doing, carrier 24 is brought into a position such as that shown in FIG. 7, wherein it is raised about hinge 40 into a generally horizontal position and upper member 36 is moved forwardly along support 38 into a position ready to accept a tubular. The tubular to be handled is engaged with the drawworks and an end thereof is pushed away from well center and placed on member 36 either on indentation 50 or guide 26. There are various options for laying the tubular down. In one embodiment, the drawworks is lowered such that the end advances along the carrier indentation 50 either directly on the indentation surface or while riding on guide 26. Guide 26 can be moved along while supporting the end of the tubular. For example, as the tubular is lowered onto the carrier, guide 26 can be driven actively, for example, by use of proportional valving and actuating levers, to guide the tubular along the carrier. Alternately, the guide may be selected to controllably float such that it may be moved in a controlled fashion in response to the pressure of the advancing tubular bearing against it, for example by use of hydraulic venting, to guide the tubular along the carrier. Alternately, guide 26 can be reversed along the carrier ahead of the tubular such that the tubular slides freely along the carrier as it is laid down by the drawworks. The ramped surfaces of indentation 50, lateral walls 52 and/or guide 26 act to guide the tubular along the carrier. The operator can monitor and possibly control the laying down operation by watching the movement of the tubular's lower and/or upper ends. In any event, once the tubular is laid down on upper member 36, carrier guide 26 can be in, or brought into, a position against the end of the tubular. For example, just prior to releasing the elevators, guide 26 may be moved to support the end of the tubular so that it can't slide back along the carrier in an uncontrolled manner.

Once the elevators are removed, the carrier can, in any order, be retracted from over the drill floor and tilted back parallel to ramp 15. The order in which part 36 is retracted or carrier 24 is tilted about hinge 40 may be determined based on the consideration of space constraints and safety on the drill floor. Although the carrier properties can be selected such that the carrier/tubular center of gravity (for most tubulars) will be on the deck side of the hinge, it may be useful to first retract the carrier (i.e. retract upper member 36 along its support 38) to move the center of gravity away from the hinge toward end 38*a* to facilitate rotation of the carrier. As the carrier is tilted, the tubular is allowed to slide down indentation 50 as controlled by guide 26. Movement of the guide along the carrier may be achieved by powering the guide's drive system or by allowing the weight of the tubular to push the guide controllably along slot 64, as may be possible, as noted above, by selection of hydraulic systems.

When guide 26 approaches its position adjacent slot 30, guide 22 is either in or brought into a position adjacent ramp 15. Finger 56 is then advanced into slot 30. In so doing, if guide 22 is positioned in the path of the finger, finger 56 may also pass through opening 70. Finger 56 may be advanced by driving guide 26 over member 36, by driving member 36 over body 38 and/or by further rotating carrier 24 down about hinge. In one embodiment, the guide and the carrier are moved to their lowermost positions and the final advancement of the finger is achieved by lowering member 36 axially over body 38.

When finger 56 becomes recessed below the deck, the weight of the tubular will be passed to deck 16 or slider 34. The weight of the tubular and its angle contact relative to the deck will tend to cause the tubular to slide to bear against wall 32 of guide 22. Guide 22 can then be controllably retracted along slot 30 to lay the tubular down on the deck. Indentations 50, 30 and/or lateral walls 52 control the movement of the tubular to restrict it to move axially along the deck's long axis $\chi$d.

Kickers 78 can then be activated to unload the tubular from the deck onto the racks.

As soon as tubular 20 is fully unloaded from carrier 24, the carrier may be moved back up to a position over drill floor 12 to receive another tubular from the rig. Carrier 24 can be moved to accept a next tubular even before the previous tubular is unloaded from the deck, which may facilitate and speed tubular handling operations.

When it is time to relocate the pipe-handling apparatus, ramp 15 may be folded about hinge pin 72 and the entire apparatus may be transported to the next drill site where it is again erected in the manner described above. During transport of the apparatus, the pipe racks may remain attached and folded against the deck, as shown in FIG. 8.

As may be appreciated, items other than tubulars may be moved using the catwalk if desired. For example, a basket of tools can be placed on upper surface 36 and may be driven by carrier 24 and guide 26 into a position for access by those on the drilling floor. The basket may move in the same way as that described by above for a tubular.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A pipe handling catwalk comprising:

a deck including an upper surface, a first end, an opposite end and a tubular support surface on the upper surface, the tubular support surface being elongate and extending between the first end and the opposite end;

a deck guide including a wall extending up from the deck upper surface and drivable along the tubular support surface of the deck;

a ramp including a connected end, an upper end and a long axis extending from the connected end to the upper end, the connected end being mounted on the deck adjacent the first end and the ramp being positionable extending at an angle from the deck;

a carrier including a support and an upper member, the upper member being elongate and including a front end, a rear end and a tubular retaining surface thereon extending along the carrier substantially in line with the tubular support surface of the deck, the upper member being axially slidable along the support substantially parallel, in plan view, with the long axis of the ramp between a first position with the front end adjacent the upper end of the ramp and a second position with the front end extending beyond the upper end of the ramp, and the support being pivotally connected by a hinge to the upper end of the ramp to remain on the ramp and being pivotally moveable about the hinge such that the rear end of the tubular retaining surface can be lifted away from the ramp to reduce the inclination of the tubular retaining surface relative to the angle of the ramp; and a carrier guide including an upstanding tubular engaging surface extending up from the tubular retaining surface and the carrier guide being drivable along the tubular retaining surface of the carrier.

2. The pipe handling catwalk of claim 1 wherein the tubular support surface includes an elongate indentation formed by inclining surfaces that converge at a slot extending along the base of the elongate indentation.

3. The pipe handling catwalk of claim 1 wherein the deck guide includes a slider driven by a drive system along the deck and the wall is connected to the slider.

4. The pipe handling catwalk of claim 1 wherein the tubular retaining surface includes an elongate indentation formed by lateral raised surfaces and includes a slot extending along the elongate indentation substantially parallel with and between the lateral raised surfaces, the slot accommodating movement of the carrier guide.

5. The pipe handling catwalk of claim 1 wherein the upstanding tubular engaging surface is positioned on a finger formed fit into a recess in the tubular supporting surface of the deck.

6. The pipe handling catwalk of claim 1 wherein the carrier guide and the deck guide are formed to releasably fit together when both are positioned adjacent the first end of the deck.

7. The pipe handling catwalk of claim 6 wherein the upstanding tubular engaging surface is positioned on a finger extendable from an end of the carrier and the deck guide includes a slider from which the wall extends and the finger and the slider are formed to be positionable with the finger passing beneath the slider.

8. The pipe handling catwalk of claim 1 further comprising a drive system for the carrier guide for driving the carrier guide from a position below the deck up though a slot in the deck to lift any tubular on the deck off the deck and onto the tubular retaining surface.

9. The pipe handling catwalk of claim 1 wherein the carrier guide includes an extension extendable beyond the rear end of the upper member for spanning any gap between the deck and the upper member.

10. A method for handling a tubular between a storage rack and a drilling rig floor, the method comprising:

loading a tubular onto a deck of a catwalk;

pushing on an end of the tubular to drive it axially along the deck and up onto a ramp carrier surface spanning between the deck and the drilling rig floor;

transferring the tubular to the ramp carrier surface; and pushing on the end of the tubular to drive the tubular up along the ramp carrier surface, axially driving the ramp carrier surface to a position extending over the drilling rig floor and pivoting the ramp carrier surface to a position substantially parallel to the drilling rig floor to move the tubular into a position accessible for pick up on the drilling rig floor.

11. The method of claim 10 wherein another tubular is loaded to the deck after transferring and while the tubular is being driven up along the ramp carrier surface.

12. The method of claim 10 wherein pushing the tubular along the ramp carrier surface and axially driving the ramp carrier surface are carried out at least in part at the same time.

13. The method of claim 10 wherein pushing the tubular along the ramp carrier surface and axially driving the ramp carrier surface are carried out sequentially.

* * * * *